United States Patent [19]

Curry

[11] 4,325,644

[45] Apr. 20, 1982

[54] WORK EQUALIZER AND LOADING FOR A SINGLE ELEMENT PRINTER SELECTION SYSTEM

[75] Inventor: Steven A. Curry, Lexington, Ky.

[73] Assignee: International Business Machines Corporation, Armonk, N.Y.

[21] Appl. No.: 173,589

[22] Filed: Jul. 30, 1980

[51] Int. Cl.[3] ..... B41J 1/60

[52] U.S. Cl. ..... 400/161.4

[58] Field of Search ..... 400/161.4, 161.5, 317.2

[56] References Cited

U.S. PATENT DOCUMENTS 3,983,984 10/1976 de Kler ..... 400/161.4

4,094,397 6/1978 Hughes ..... 400/161.4

*Primary Examiner*—Ernest T. Wright, Jr.

*Attorney, Agent, or Firm*—Laurence R. Letson

[57] ABSTRACT

An improvement to the shuttle selection control system disclosed in U.S. Pat. No. 4,094,397 is described where a biasing spring is urgingly engaged with the rack of a rack and pinion arrangement used to rotate the type element, and thereby place a spring load on the system such that the force between the slider blocks of the selection system and the stop member engaged by the slider block will be reliably increased, while at the same time, preventing an increase in the drive requirements of the drive motor for the system. This spring biasing has a secondary benefit in that it tends to uniformly cause consolidation of all tolerances and relative movement in the system due to wear and thus stabilize the system for improved detenting of the typehead.

4 Claims, 2 Drawing Figures

WORK EQUALIZER AND LOADING FOR A SINGLE ELEMENT PRINTER SELECTION SYSTEM

BACKGROUND OF THE INVENTION

This invention relates to the control of the type element of a single element typewriter.

U.S. Pat. No. 4,094,397 to Hughes and commonly assigned herewith illustrates a shuttle and slider blocks useful in controlling and defining the amount of rotation of a typehead or type element on a single element typewriter, such as disclosed in U.S. Pat. No. 3,983,984 to deKler, and similarly commonly assigned herewith.

U.S. Pat. No. 4,094,397 incorporates by reference the disclosure of U.S. Pat. No. 3,983,984 and discloses an improvement to the system of U.S. Pat. No. 3,983,984 in the replacement of the slider blocks 18 contained in the deKler patent.

This specification incorporates by reference U.S. Pat. No. 4,094,397 filed Jan. 3, 1977, patented June 13, 1978, to Frank M. Hughes which, in turn, incorporates by reference U.S. Pat. No. 3,983,984 filed June 26, 1975 and patented Oct. 5, 1976 to Dirk deKler.

To eliminate the need for reduntant and unnecessary additional disclosure, the shuttle and slider block arrangement of U.S. Pat. No. 4,094,397 is disclosed together with the improvement thereto, herein.

OBJECTS OF THE INVENTION

It is an object of the invention to increase the forces between the slider block of the selection control system and the rotate defining stop members, without increasing peak motor loading.

It is another object of the invention to reduce the amount of undesired movement of the typehead to improve locational predictability of the typehead.

The objects of the invention are accomplished by the improvement of the invention described herein.

In the selection system of the type described in U.S. Pat. No. 4,094,397, a shuttle and slider blocks are spring forced against stops which define the extent of movement of the slider blocks which, in turn, define the rotational movement of the typehead of the typewriter.

In order to increase the force with which the slider blocks engages the stops, it is necessary to increase the spring bias forces against the slider block which, in turn, will be transmitted to the stops. This may be accomplished by adding a tension spring between the typewriter frame and the rack of the rack and pinion portion of the selection system found in the print rocker and more completely described in U.S. Pat. No. 3,983,984 which is, in turn, incorporated into U.S. Pat. No. 4,094,397 by reference therein. By adding the spring between the frame of the typewriter and the rack, rather than increasing the spring force between the slider block and the shuttle, forces exerted by the added spring are utilizable for the desired result of increasing the engagement force between the slider block and the stop members while not increasing the peak load on the selection drive motor and thereby not necessitating the increase in the motor size. This is accomplished by virtue of the fact that the drive motor is storing energy in or doing work on only one of the two springs at any one time during the typical machine cycle and, thus, utilizes a period during the machine cycle which is otherwise wasted insofar as drive motor capacity is concerned. The tension spring can be replaced by a compression spring acting on the opposite end of the rack positioned between the rack and the typewriter frame although the tension spring is easier to work with. The inclusion of this improvement spring acts to increase the reliability of the selection system inasmuch as it constantly biases the entire system in one direction to eliminate accumulated tolerances and thereby reduce the headplay of the type element. By reducing the play of the type element, the detenting of the type element prior to printing is more easily accomplished and much more reliable.

A better understanding of the invention may be had by referring to the drawing and detailed description to follow.

DETAILED DESCRIPTION OF THE INVENTION

Figure 1:
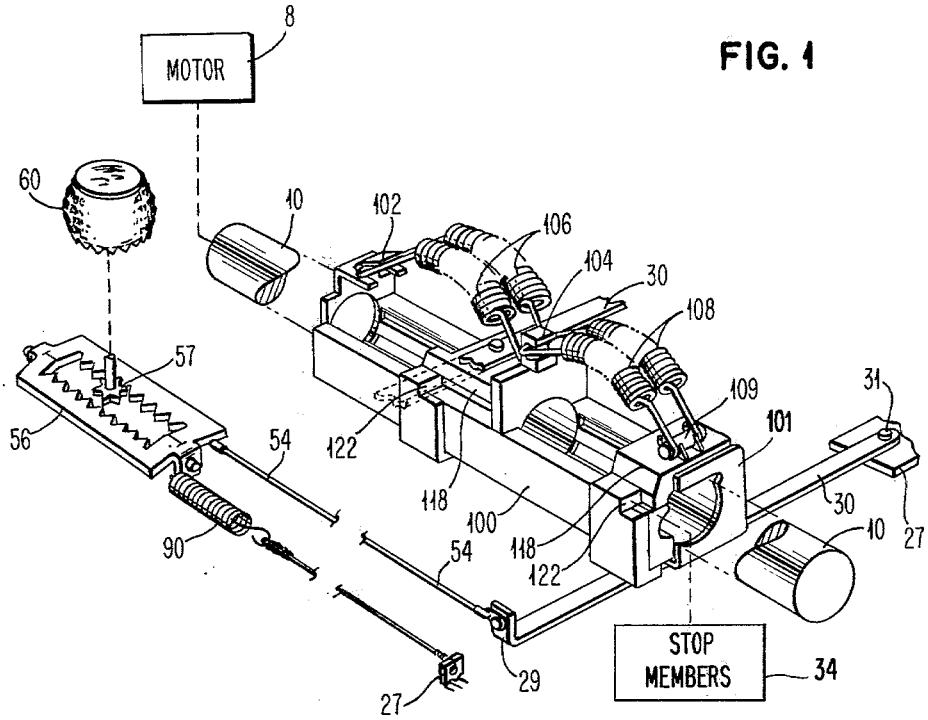
FIG. 1 illustrates the shuttle and slider block arrangement disclosed in U.S. Pat. No. 4,094,397, with the improvement of the present invention added thereto.

Insofar as possible, the reference numerals of the incorporated patents are used for the same parts in this disclosure where shown and duplication is avoided.

Referring to FIG. 1, motor driven shaft 10 is driven by motor 8 rotationally. The rotation of shaft 10 will cause the oscillation of shuttle 100 axially along shaft 10 in response to the rotation of shaft 10. The interaction of shaft 10 and particularly groove 116 illustrated in U.S. Pat. No. 4,094,397 in FIG. 2 acting against pin 126 on a part of shuttle 100, likewise illustrated in FIG. 2 of U.S. Pat. No. 4,094,397 causes the movement of the shuttle 100 along shaft 10. As slider block 118 translates with shuttle 100 and stop surface 122 thereon engages one of the stop members 34 as shown in FIG. 1 of U.S. Pat. No. 3,983,984, slider block 118 will stop and further movement of the shuttle 100 is accommodated by springs 108. Springs 108 provide a biasing force to insure that stop surface 122 remains against the stop member 34. A more detailed understanding of this operation may be had by a thorough review of U.S. Pat. Nos. 4,094,397 and 3,983,984.

Shuttle 100 carries slider block 118 and slider block 118 may move relative to the shuttle 100. Springs 108 are flexed to span between slider block 118 and shuttle 100 to bias slider block 118 and to provide spring relief for slider block movement.

As slider block 118 translates axially along the axis of shaft 10, movement multiplier arm 30 attached to the block 118 will pivot with respect to grounding point 31. Grounding point 31 is part of the typewriter frame 27. As movement multiplier arm 30 translates in response to the movement of slider block 118, the displacement of the outer end thereof 29 will be in proportion to the respective lever arm lengths. End 29 of movement multiplier arm 30 is attached to link 54 to transmit motion from arm 30 to rack 56 located in and supported by the rocker 68 as shown in U.S. Pat. 3,983,984. Rack 56 is provided with two sets of gear teeth in the form of oppositely arranged racks. Pinion 57 is engageable with one of the racks forming rack 56 and is coupled as illustrated in FIG. 1 of U.S. Pat. No. 3,983,984 to type element 60.

Attached to rack 56 and urging rack 56 down and to the right in FIG. 1 is a tension spring 90. Tension spring 90 acts to urge rack 56 toward frame member 27 to which the opposite end of tension spring 90 is attached. This urging will act to accumulate all the play in the system which will be eliminated and type element 60 will be consistently positioned for each and every position of slider block 118.

Figure 2:
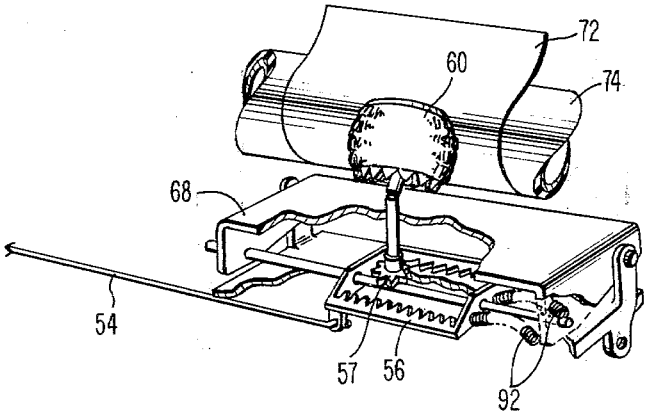
FIG. 2 illustrates a compressive spring force exerted on the rack in lieu of the tension spring force found in FIG. 1.

An alternative embodiment is illustrated in FIG. 2 wherein a spring arrangement similar to the springs 108 are used as a compressive biasing force between the frame of the rocker 68 and the rack 56. The compressive force of spring 92 may be made substantially equivalent to the tension force exerted by spring 90 in FIG. 1 inasmuch as both tend to urge rack 56 in the identical direction which is the same direction as the spring biasing forces on slider block 118.

As the shaft 10 rotates and shuttle 100 oscillates initially toward the right as a result of the rotation of shaft 10 and the interaction between groove 116 and pin 126 as shown in FIG. 2 of U.S. Pat. No. 4,094,397, the springs 108 will maintain slider block 118 against the end 101 of shuttle 100 until such time as surface 122 will come in contact with stop members 34 or stop 20 as shown in FIGS. 1 and 3 of U.S. Pat. No. 3,983,984.

At the point that surface 122 engages a resistance force, spring 108 will begin to collapse and buckle, storing energy, maintaining a substantially uniform force against the stop 34. During the movement described immediately above, tension spring 90 will be collapsing and releasing energy as movement multiplier arm 30 also moves with slider block 118 until such time as slider block 118 is stopped. The remaining tension in spring 90 will add to the force urging block 118 along shaft 10 and will effectively assist springs 108 in maintaining slider block 118 against the end 101 of shuttle 100. Upon engagement of surface 122 with the stop member 20, 34 of U.S. Pat. No. 3,983,984 and the stopping of slider block 118 from further translation, the force exerted by spring 90 through rack 56 and link 54 will be additive to that exerted by springs 108 and being transmitted to block 118. This effectively raises the engagement force between surface 122 and any stop member 20, 34 engaged thereby. As spring 108 is being collapsed by further rotation of shaft 10 and the further shifting of shuttle 100, spring 90 is in a condition of stability and equilibrium and is not affected by drive motor 8. Energy is only being stored at this point of the cycle in spring 108.

As the shaft 10 continues to rotate, slider block 118 will be engaged by shuttle 100 on its return throw and as shuttle 100 moves leftward as seen in FIG. 1 with respect to slider block 118, spring 108 will give up energy previously stored therein. This force assists in the reverse movement of shuttle 100. Upon the restoration of slider block 118 against the end 101 of shuttle 100, further movement of shuttle 100 will effect the movement of multiplier arm 30 in a clockwise direction as viewed in FIG. 1, thus pushing on link 54 and rack 56 to return pinion 57 and type element 60 to the home position normally occupied during times when no selection is occurring.

As this movement of rack 56 occurs in response to the pushing by link 54, tension spring 90 is extended and energy stored therein. As can be seen from the above, energy is stored in tension spring 90 only after the slider block 118 has been returned to abutting engagement with the end 101 of shuttle 100 and there is no work being performed on spring 108.

Conversely, spring 108 is only being worked on during the portion of the cycle after surface 122 engages a restraining force and spring 108 is being collapsed thereafter by further movement of shuttle 100. Inasmuch as the stopping of slider 118 also stops rack 56, at that point there is not further movement with respect to spring 90. Inasmuch as spring 90 is not being deformed or allowed to deform, there is no work input or output from spring 90 during the period of time when work is being performed on spring 108.

This arrangement allows motor 8 to drive shaft 10 and only perform work on spring 90 or spring 108 but not to allow work to be performed on both sets of spring biasing means 90, 108 at the same time. Inasmuch as there is substantial portion of the cycle during which spring 108 is not having energy stored in it by the rotation of shaft 10, this allows work to be performed by motor 8 without increasing the peak loads on motor 8 and thereby requiring an increase in the motor size or drive capability.

Referring to FIG. 2, an alternative embodiment involves the use of a spring 92 equivalent to that of spring 108 in structure and characteristics. The spring 90 may be attached between the rocker frame 68 and rack 56 to provide a compressive force against rack 56 which, in turn, will act through link 54. The functional result is the same as the embodiment involving the tension spring 90 as illustrated in FIG. 1.

The loading or work performed on spring 92 will be done during that portion of the cycle when the shuttle 100 is returning to its home position and not during a time when the spring 108 is being compressed or flexed. Thus, regardless of whether tension spring 90 of flex spring 92 are utilized as illustrated, the loading of these respective springs 90, 92 occurs during a portion of the cycle during which no work is being performed on spring 108 and, thus, does not increase peak load on drive motor 8.

The holding members 102, 104, spring 106, and attachment point 109 are all described in U.S. Pat. No. 4,094,397 and record sheet 72 and platen 74 are described in U.S. Pat. No. 3,983,984, and are not essential to an understanding of the present invention and, as such, are adequately described by incorporation.

Having described the invention in two embodiments, it is understood that minor variations may be made in the invention without departing from the spirit of the invention and from the following claims.

I claim:

1. A selection system for a single print element printer comprising a frame, a print element, rack and pinion means for rotating said print element, linkage means for moving said rack with respect to said pinion, a movement multiplier arm having two ends, and connected to said linkage means at one end thereof, said multiplier arm having at the opposite end thereof a grounded pivot and connected at a point intermediate said ends to a controlled displaceable member, powered means for effecting reciprocal movement of said controlled displaceable member, at least a stop member, first spring bias means urging said controlled displaceable member into engagement with said stop member, the improvement comprising:

a second bias means urgingly engaged with said rack in the same direction of movement as said displaceable member is spring biased by said first spring bias means, whereby said second bias means increases the engagement force between said controlled displaceable member and said stop member through said multiplier arm without increasing required power of said powered means during any portion of the cycle, above the highest level of power provided to said powered means, without said improvement.

2. The selection system of claim 1 wherein said second bias means is a tension spring.

3. The selection system of claim 2 wherein said tension spring is attached at one end to said frame of said printer.

4. The selection system of claim 2 wherein said tension spring is positioned and attached to provide an additive bias on said displaceable member against said stop member.

* * * * *